United States Patent [19]

Hill

[11] Patent Number: 5,024,536

[45] Date of Patent: Jun. 18, 1991

[54] RESEALABLE COMPARTMENTED BAGS

[76] Inventor: Diane E. Hill, 8040 E. Woodwind Ave., Orange, Calif. 92669

[21] Appl. No.: 553,238

[22] Filed: Jul. 16, 1990

[51] Int. Cl.[5] ..... B65D 33/24; B65D 30/22

[52] U.S. Cl. ..... 383/38

[58] Field of Search ..... 383/38, 40; 229/72; 150/147

[56] References Cited

U.S. PATENT DOCUMENTS

| | | | |
|---|---|---|---|
| 1,202,069 | 10/1916 | Kantro | 229/72 |
| 1,276,101 | 8/1918 | Oakley | 229/72 |
| 1,510,243 | 9/1924 | Perry | 383/38 |
| 1,586,016 | 5/1926 | Walters | 229/72 |
| 2,357,339 | 9/1944 | Mathieu | 383/38 |
| 3,008,835 | 11/1961 | Madding | 383/38 |
| 3,311,145 | 3/1967 | Zalk et al. | 383/38 |
| 3,370,629 | 2/1968 | Neuman | 383/38 |
| 3,891,138 | 6/1975 | Gla's | 383/38 |

*Primary Examiner*—Stephen P. Garbe

*Attorney, Agent, or Firm*—Haynes N. Johnson

[57] ABSTRACT

A bag having a plurality of pockets, including front and back panels made of plastic sheet material, the panels being adhered together along their side and bottom edges along seal lines, and the panels being secured together along their top edges by a resealable closure, and at least one transverse seal line substantially parallel to the side edges and running from the bottom edges to the resealable closure, the transverse seal line securing together the front and back panels to define a plurality of separated pockets. In a modification, a plurality of such front and back panels can all be secured together along their bottom edges to create additional pockets and the transverse seal lines may be secured to one another.

3 Claims, 3 Drawing Sheets

Fig. 6.
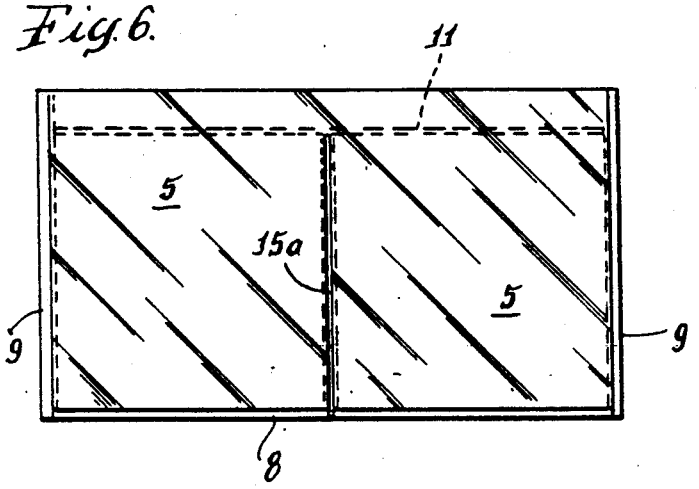
Fig. 5
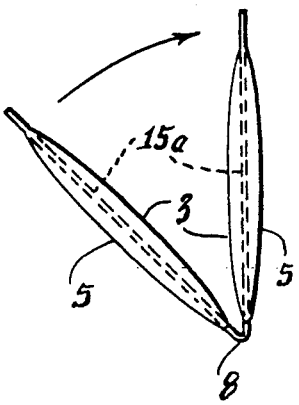
Fig. 8.
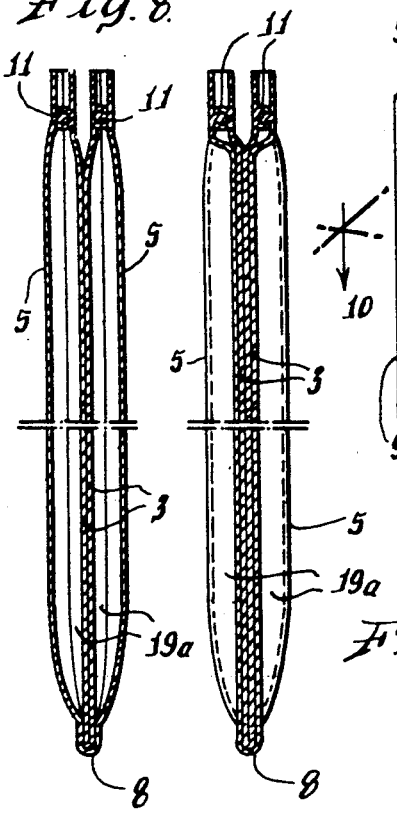
Fig. 7.
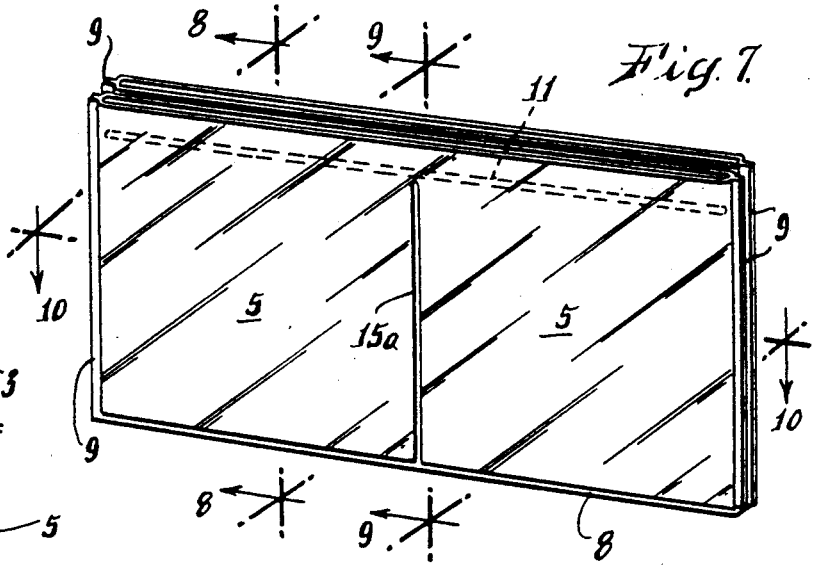
Fig. 9.
Fig. 10.
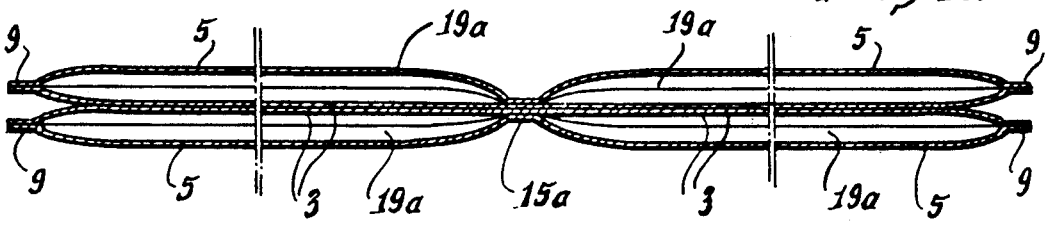

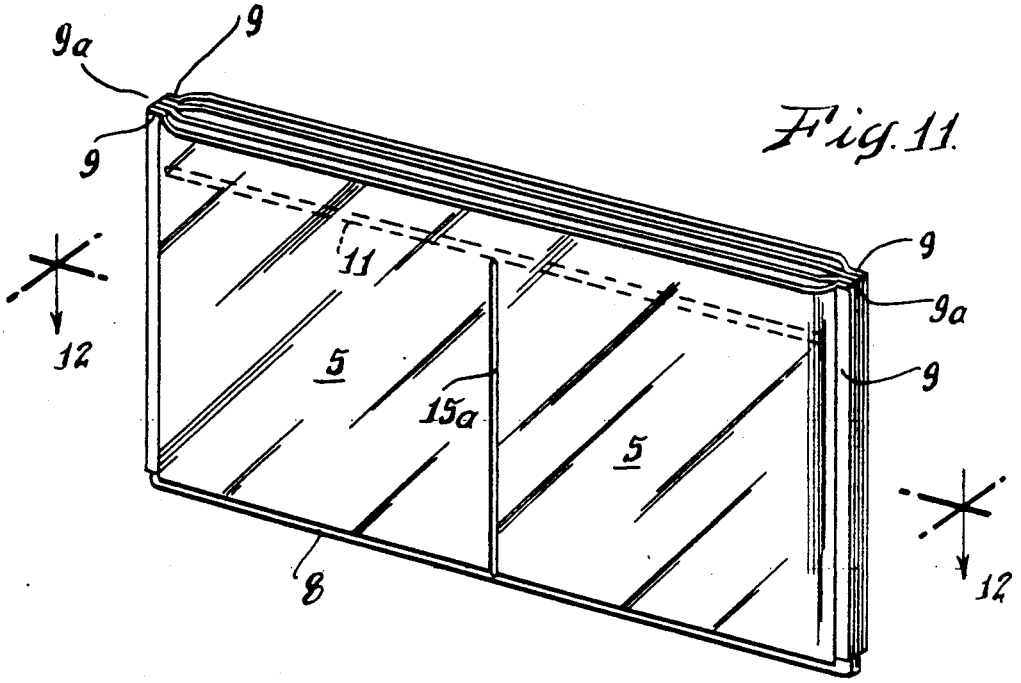
Fig. 11.
Fig. 12.
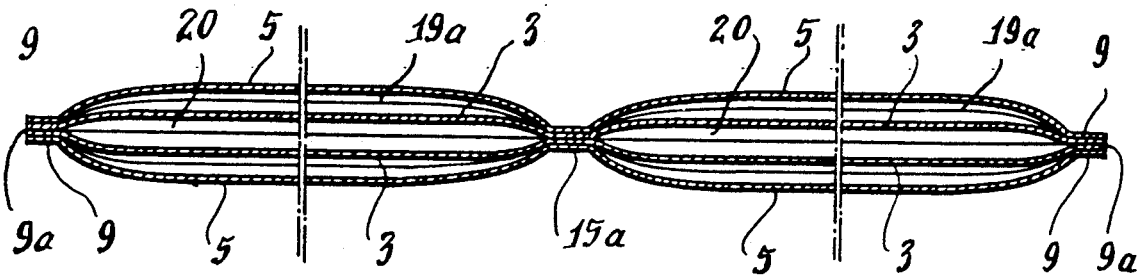

RESEALABLE COMPARTMENTED BAGS

FIELD OF THE INVENTION

This invention relates to the field of plastic bags and, in particular, to such bags formed of thermoplastic material. It provides a system by which such bags can be compartmentalized into separate pockets, permitting a single bag to carry different items, but to keep them separate.

Though usable for many different purposes, my bag is especially useful for carrying different kinds of foods, without them getting mixed together. For example, a moist food could be contained in one pocket, and a dry food in another. A bag might be used in a child's lunch box and have a sandwich in one side and fruit in the other.

BACKGROUND OF THE INVENTION

Extruded plastic bags having extruded resealable closures are old and have been used many years for many different purposes. Normally, these bags are made by extruding the two sides in a direction parallel to the direction of the closure, so that the closure can be extruded at the same time. The two sides are then heat-sealed together at their edges and separated. This process has meant that each separate bag contains only one compartment, or pocket; and that compartment is opened and closed by use of the resealable closure at the top.

BRIEF SUMMARY OF THE INVENTION

I have found that by adding one or more simple steps to the manufacturing process, bags can be made which have multiple compartments. For example, were one to heat seal the two bag sides together in a vertical line (transverse to the closure) running from the closure to the bottom edge, the bag would be divided into two pockets. The heat seal line could pass through the closure or stop just short of it, depending upon whether or not one wished to have the closure operate separately for the two pockets or to be able to open it for its entire length, giving access to both pockets at one time.

Various modifications can be made to my invention to provide for different numbers and sizes of pockets. A divided gallon size bag would be useful for storing different foods, such as different meats, or different fruits, in a refrigerator. A smaller bag could be used in a lunch box. Many other uses are, of course, possible, such as separating fish hooks and lures, or separating art supplies to be used in a school lesson.

DESCRIPTION OF THE DRAWINGS

FIGS. 5, 6, and 7 show further steps in the construction of the modified bag.

FIGS. 8 and 9 are vertical sections, taken on lines 8—8 and 9—9, respectively, of FIG. 7.

FIG. 10 is a horizontal section, taken on line 10—10 of FIG. 7.

FIG. 11 is a perspective view of a further modification of the bag of FIG. 7.

FIG. 12 is a horizontal section taken on line 12—12 of FIG. 11.

DETAILED DESCRIPTION OF THE INVENTION

Figure 1:
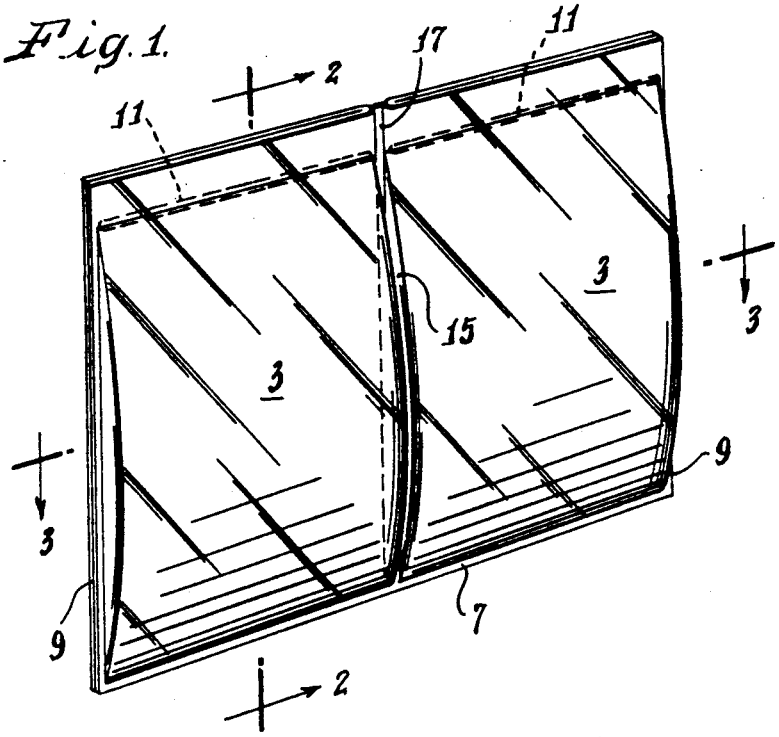
FIG. 1 is a perspective view of one form of my invention, showing a bag with two pouches.
Figure 2:
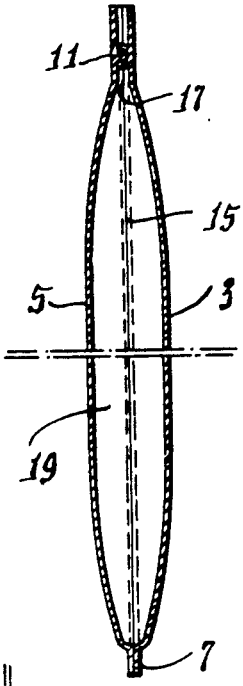
FIG. 2 is a vertical section, taken on line 2—2 of FIG. 1, showing the heat seal line which divides the bag into two compartments.
Figure 3:
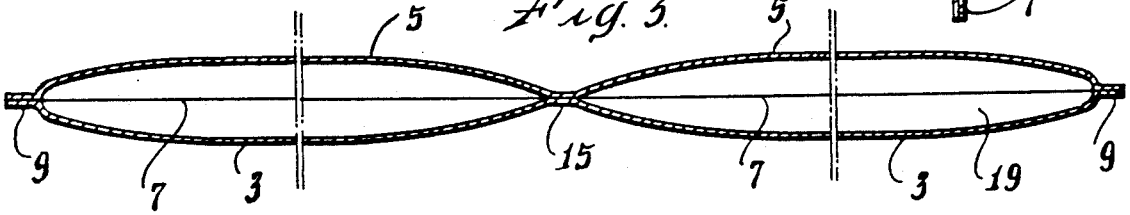
FIG. 3 is a horizontal section, taken on line 3—3 of FIG. 1, showing the two compartments.

One form of my compartmented bag 1 is shown in FIGS. 1, 2, and 3. The bag is formed of any desired thermoplastic material and includes front panels 3, back panels 5, bottom seal 7, side seals 9, and resealable closure 11. This much of the bag is old and may be made in any conventional manner. For example, the front and back panels, and the resealable closure can be extruded together in a direction parallel to the longitudinal direction of the closure, with side seals 9 being formed periodically by the application of heat at the same time that the bags are severed.

By "resealable closure" I mean any type of resealable closure. I prefer a plastic zip-lock structure, but it could also be a zip-lock with a slider, or any similar structure.

The bag 1 is compartmented by running a seal line 15 vertically in the middle of the bag. This can be done by forming seal line 15 by heat sealing at the time the rest of the bag is being formed, or subsequently. Line 15 is transverse to bottom seal 7 and resealable closure 11 and divides the bag into two approximately equal compartments or pockets 19. A larger number of compartments can be made by the same method, if desired.

Preferably, seal line 15 runs from bottom seal 7 to, but not across closure 11, stopping at point 17. As a result, both compartments can be opened or closed together by opening or closing closure 11. Alternatively, seal line 15 can be continued across closure 11, in effect making it two separate closures.

A four-compartment bag 21 is shown in FIGS. 4 through 10. It is made from a bag which has closures 11 along both the top and bottom edges (FIG. 4) This structure can be extruded this way, as is done for the structure of FIG. 1, with closures being extruded on both of these edges, and a common bottom seal 8 passing along the center. Alternatively, this structure can be made by taking two of the bags of FIG. 1 and heat sealing them together along their bottom seals 7 to form common seal 8.

These bags, with the common seal 8 are then folded together so that the two resealable closures are proximate to each other. If transverse seal lines **15*a* (similar to transverse seal line 15) have been formed by heat sealing prior to folding, one then has a four compartment bag. I prefer, however, to form transverse seal line 15*a* after the bags have been folded, and to heat seal the two sections together as line 15*a*** is being formed. This latter method serves to join both sides together as a unit, which cannot thereafter be unfolded.

Figure 4:
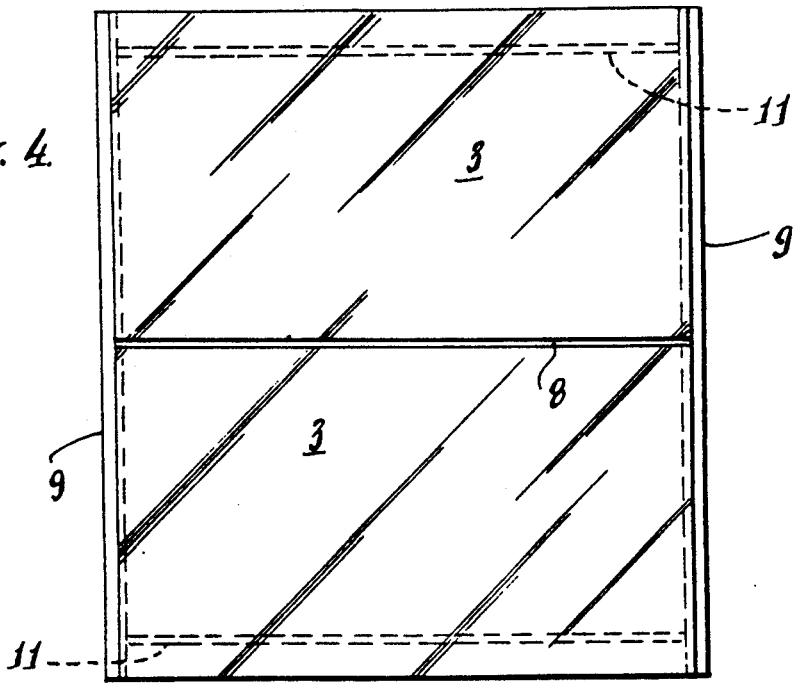
FIG. 4 is a modification of my bag, partially constructed. The bag will include four pockets.

As can now be seen, FIG. 4 shows this modified bag before folding; FIG. 5, during folding; FIG. 6, when the folding is complete; and FIG. 7, the finished bag. The finished bag has four pockets **19*a*** which can carry four different types of items without commingling.

Two additional pockets can be obtained with this latter structure if the end seals 9 are sealed together, forming seal **9*a*, as shown in FIG. 11. By so sealing the bag, pockets are formed between the inner surfaces of the pockets 19*a***. These new pockets will not have resealable closures at the top but are, nevertheless, useful for many purposes.

I claim:

1. A bag having a plurality of pockets, said bag including at least four sheets of plastic sheet material of similar size and rectangular shape and overlying one another, said sheets being adhered to one another by a common seal line along the bottom edges thereof, and defining two front sheets and two back sheets, said two front sheets being secured to one another by seal lines along their side edges and with a first resealable closure along their top edges, said two back sheets being secured to one another by seal lines along their side edges and with a second resealable closure along their top edges, at least one first transverse seal line substantially parallel to said side edges of said two front sheets and running from said bottom edges thereof to said first resealable closure, said transverse seal line securing together said two front sheets, and at least one second transverse seal line substantially parallel to said side edges of said two back sheets and running from said bottom edges thereof to said second resealable closure, said transverse seal line securing together said two back sheets, whereby a bag is provided having a multiplicity of separate pockets.

2. A bag as set forth in claim 1 in which said first transverse seal line and said second transverse seal line are sealed together thereby securing together said two front sheets and said two back sheets.

3. A bag as set forth in claim 1 in which said two front sheets and said two back sheets are secured to one another along their side edges, thereby defining additional pockets.

* * * * *